United States Patent [19]

Larson et al.

[11] 4,179,640

[45] Dec. 18, 1979

[54] HID SODIUM LAMP WHICH INCORPORATES A HIGH PRESSURE OF XENON AND A TRIGGER STARTING ELECTRODE

[75] Inventors: Daniel A. Larson, Cedar Grove, N.J.; Robert J. Zollweg, Monroeville, Pa.

[73] Assignee: Westinghouse Electric Corp., Pittsburgh, Pa.

[21] Appl. No.: 857,482

[22] Filed: Dec. 5, 1977

[51] Int. Cl.[2] ..... H01J 17/34

[52] U.S. Cl. ..... 315/47; 315/58; 315/71; 315/73; 315/DIG. 5

[58] Field of Search ..... 315/47, 71, 73, 58, 315/DIG. 5

[56] References Cited

U.S. PATENT DOCUMENTS

| | | | |
|---|---|---|---|
| 3,248,590 | 4/1966 | Schmidt | 313/184 |
| 3,384,798 | 5/1968 | Schmidt | 313/184 |
| 3,721,845 | 3/1973 | Cohen et al. | 315/47 X |
| 3,746,914 | 7/1973 | Olson et al. | 315/47 |
| 3,755,708 | 8/1973 | Audesse | 315/47 |
| 3,757,158 | 9/1973 | Kopelman | 315/47 |
| 3,757,159 | 9/1973 | Gutta et al. | 315/47 |
| 3,900,753 | 8/1975 | Richardson | 313/198 |
| 4,037,129 | 7/1977 | Zack et al. | 313/198 X |
| 4,072,878 | 2/1978 | Engel et al. | 315/DIG. 5 |

*Primary Examiner*—Alfred E. Smith
*Assistant Examiner*—Charles F. Roberts
*Attorney, Agent, or Firm*—W. D. Palmer

[57] ABSTRACT

High-intensity-discharge sodium lamp incorporates as a starting gas xenon at a pressure between 50 and 300 torrs, in order to improve the lamp efficiency and the spectral power distribution of the discharge. To facilitate lamp starting on a conventional pulse-type starting circuit, a trigger electrode is wrapped about the exterior of the arc tube proximate one of the lamp electrodes, with the potential applied to the trigger electrode during lamp starting being the same as that which is applied to the other or more remote lamp electrode. The starting pulse applied between the trigger electrode and the proximate lamp electrode initiates the lamp discharge. The trigger electrode also extends along the outer surface of the arc tube contiguous therewith toward the other electrode and the discharge, once initiated, progresses toward the other electrode. If the arc tube is pervious to the migration of sodium ions therethrough under the influence of an electric field during the normal lamp operation, the trigger electrode is effectively removed from the circuit by a switch or a high impedance to prevent such sodium ion migration.

7 Claims, 8 Drawing Figures

HID SODIUM LAMP WHICH INCORPORATES A HIGH PRESSURE OF XENON AND A TRIGGER STARTING ELECTRODE

BACKGROUND OF THE INVENTION

This invention relates to high-intensity-discharge (HID) sodium-vapor lamps and, more particularly, to HID sodium-vapor lamps which utilize a relatively high fill pressure of xenon and a particular trigger electrode construction to facilitate starting.

U.S. Pat. No. 3,248,590 dated Apr. 26, 1966 to Schmidt broadly discloses HID sodium-vapor lamps and in FIG. 4 thereof discloses the effect of varying the xenon fill pressure from 0 to 300 torrs, when the discharge sustaining material is sodium per se. In the bridging paragraph between columns 7 and 8 of this patent and the first full paragraph in column 8 is disclosed the addition of mercury as a discharge-sustaining substance.

U.S. Pat. No. 3,384,798 dated May 21, 1968 to Schmidt discloses the use of sodium-mercury amalgam as a discharge-sustaining filling along with xenon starting gas at a fill pressure of 20 torrs.

In U.S. Pat. No. 3,721,845 dated Mar. 20, 1973 to Cohen et al. is disclosed the use of a heater wire wrapped around an insulating rod which is closely spaced to the arc tube portion of an HID sodium lamp. Once the lamp starts, the heater is disconnected from the circuit by means of a thermal switch. A starting aid in the form of wire loops extends between the electrodes and these wire loops are carried proximate the exterior surface of the arc tube.

In U.S. Pat. No. 3,746,914 dated July 17, 1973 to Olson et al. is disclosed a tungsten resistance heater coiled about the arc tube in order to facilitate starting. After the lamp is started, the heater is cut out by means of a thermal switch.

U.S. Pat. No. 3,757,158 dated Sept. 4, 1973 to Kopelman discloses a sodium-vapor lamp arc tube having a spiral groove on the outer surface thereof with a heater wire carried within the spiral groove. Once the lamp is started, the heater wire is cut out of the circuit by means of a thermal switch.

In U.S. Pat. No. 3,757,159 dated Sept. 4, 1973 to Gutta et al. is disclosed a starting aid heater carried in a ceramic tube positioned proximate and exterior to an arc tube. An additional starting aid in the form of a fine wire encircles and is coiled about the arc tube and the ceramic sleeve.

U.S. Pat. No. 3,755,708 dated Aug. 28, 1973 to Audesse discloses an external heater spaced proximate an arc tube with a heater coiled about an insulating support. Once the lamp has started, the heater wire is removed from the circuit by means of an external switch.

U.S. Pat. No. 3,900,753 dated Aug. 19, 1975 to Richardson discloses a loop starting aid wrapped around the arc tube and a gas fill within the arc tube of a Penning mixture. A thermal switch removes the loop starting aid from circuit after the lamp is started.

U.S. Pat. No. 4,037,129 dated July 19, 1977 to Zack et al. discloses a multiple turn wire starting aid wound about an arc tube and extending longitudinally along the arc tube for a distance that is at least 10 percent of the arc tube length. The wire starting aid electrically connects to one of the electrodes and is removed from the circuit after the lamp is operating by a heat actuated switch. The arc tube utilizes a Penning gas mixture to facilitate starting.

SUMMARY OF THE INVENTION

There is provided a HID sodium-vapor lamp adapted to be operated at about a predetermined nominal wattage input in conjunction with a ballast which generates a high-voltage starting pulse to initiate the lamp discharge and thereafter limit the current through the lamp to cause it to normally operate at about its nominal wattage. The lamp comprises a sealed, elongated refractory arc tube of predetermined dimensions and design and enclosing electrodes which are operatively positioned proximate the ends thereof. A first pair of lead-in conductors is sealed through the arc tube proximate its ends and one conductor of the first pair connects to one of the electrodes with the other conductor of the first pair connecting to the other of the electrodes. As a discharge sustaining filling, there is included within the arc tube sodium or sodium plus mercury in predetermined total amount and in predetermined atom ratio, along with xenon at a fill pressure betwen 50 torrs to 300 torrs. An outer light-transmitting envelope encloses the arc tube to provide a predetermined operating environment therefor and external electric contact means are secured to outer envelope to provide electrical connection to the lamp, with a second pair of lead-in conductors sealed through the outer envelope and connecting to the external electrical contact means. The metallic supporting frame is retained within the outer envelope and supports the arc tube in predetermined position and electrically connects one conductor of the first pair of lead-in conductors to one conductor of the second pair of lead-in conductors, with the other conductor of the first pair of lead-in conductors electrically connected to the other conductor of the second pair of lead-in conductors In accordance with the present construction, a trigger wire starting means comprising an elongated refractory metal member connects to and extends from the supporting frame to a position contiguous with and at least partially surrounding that outer surface portion of the arc tube which is proximate the other electrode which connects to the other conductor of the first pair of lead-in conductors, and the elongated metal member also extends a predetermined distance toward the other electrode along the outer surface of the arc tube and contiguous therewith. For some designs, the arc tube during lamp operation will be pervious to migration of sodium ions therethrough under the influence of an electric field and in such case, the elongated metal member of the trigger starting device is effectively electrically isolated from the supporting frame after the lamp is normally operated by having included in series circuit therewith a high impedance capacitor means or a high impedance resistor means or circuit interrupting means, which acts to electrically isolate the elongated metal member from the frame after a lamp is normally operating. The high pressure of xenon improves both the efficacy and the spectral power distribution of the lamp as normally operated and the specific trigger starting mechanism enables the lamp to be started and operated with a conventional starting and operating ballast.

BRIEF DESCRIPTION OF THE DRAWINGS

For a better understanding of the invention, reference may be had to the preferred embodiment, exemplary of the invention, shown in the accompanying drawings, in which.

DESCRIPTION OF THE PREFERRED EMBODIMENT

Figure 1:
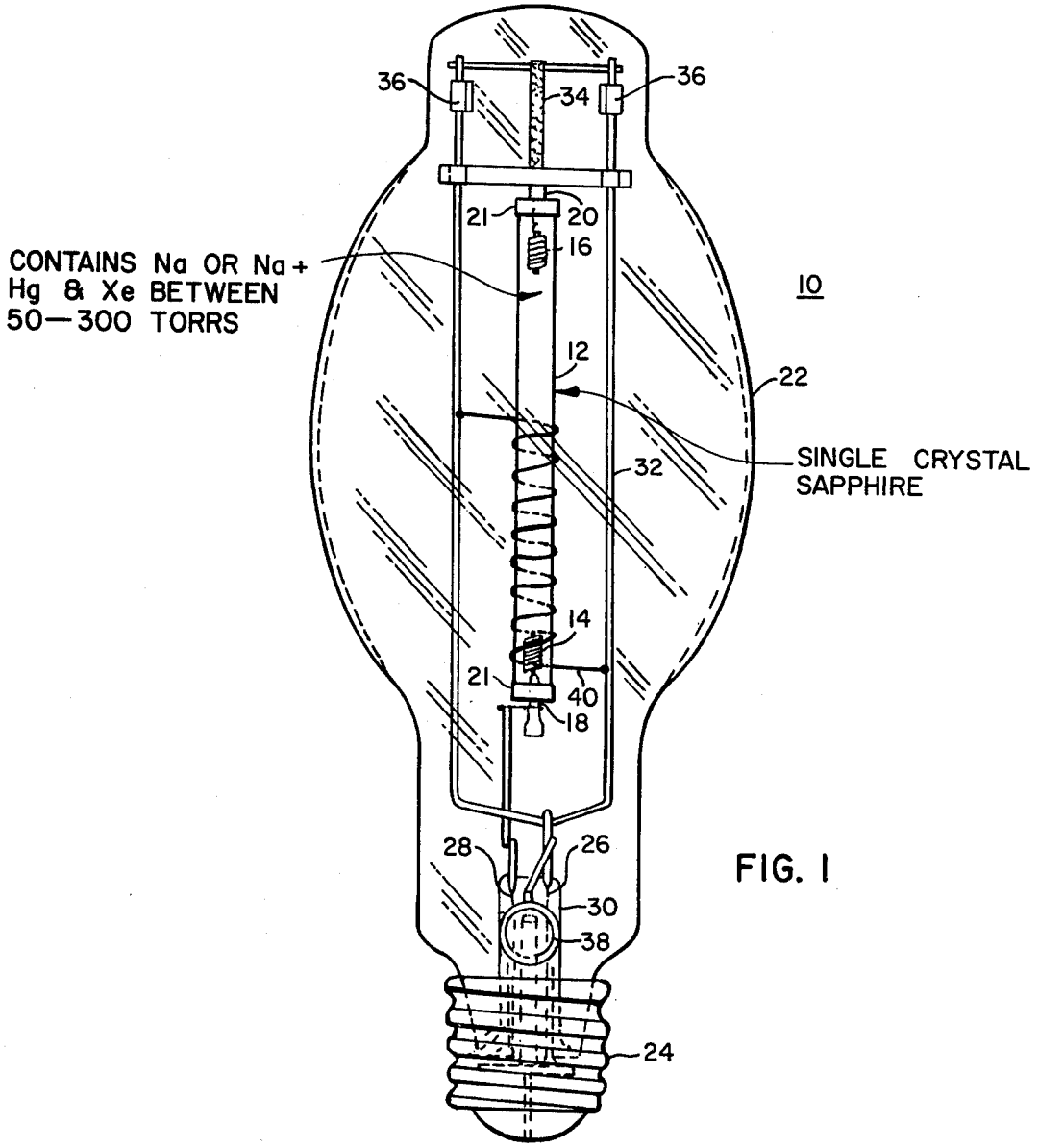
FIG. 1 is an elevational view of an HID sodium vapor lamp constructed in accordance with present invention and incorporating a trigger electrode.

With specific reference to the form of the invention illustrated in the drawings, the lamp 10 in FIG. 1 is an HID sodium vapor lamp comprising a sealed, light-transmitting, elongated, refractory arc tube 12 of predetermined dimensions and design enclosing electrodes 14 and 16 proximate the ends thereof. A first pair of lead-in conductors 18 and 20 are sealed through niobium end caps 21 which in turn are sealed to the arc tube proximate the ends thereof. The lead-in conductor 18 electrically connects to the electrode 14 and the other conductor 20 electrically connects to the electrode 16.

As a starting and operating discharge-sustaining filling, the arc tube 12 encloses sodium in predetermined total amount or sodium plus mercury in predetermined total amount and in predetermined atom ratio along with xenon at a filling pressure under ambient conditions between 50 torrs to 300 torrs. As a specific example, for an arc tube intended to be operated at a nominal wattage of 150 watts, the dimensions of the arc tube are such that it has an inside diameter of 5.5 mm, and an electrode spacing of 48 mm. The preferred discharge sustaining filling is sodium plus mercury as an amalgam in amount of 30 mg with the atom ratio of sodium to mercury being 0.65. In the case sodium per se constitutes the primary discharge-sustaining filling, the specific arc tube is initially dosed with 10 mg of sodium.

An outer light transmitting envelope 22 encloses the arc tube 12, in order to provide a predetermined operating environment therefor, which preferably is a hard vacuum. External electric contact means such as a conventional base 24 is secured to the outer envelope 22 in order to provide electrical connection to the lamp 10. A second pair of lead-in conductors 26 and 28 are sealed through the outer envelope 22 via a conventional stem press 30 and connect to the lamp base 24.

A metallic supporting frame means 32 is retained within the outer envelope 22 and supports the arc tube 12 therein in predetermined position, such as a centrally disposed location. The frame 32 electrically connects one lead-in conductor 20 of the first pair of conductors to one conductor 26 of the second pair of conductors which are sealed through the outer envelope. The other conductor 18 of the first pair of conductors directly electrically connects to the conductor 28 of the second pair of conductors. Electrical connection between the frame 32 and the lead-in conductor 20 is made via a resilient braided conductor 34 to facilitate expansion and contraction of the arc tube. The other lamp components are generally conventional and the frame 32 is supported at the dome portion of the envelope 22 by resilient leaf spring-like members 36. The lamp also incorporates getter-flashing members 38 at the base thereof from which getter is flashed during lamp fabrication in order to obtain the hard vacuum which comprises the protective and operating environment for the arc tube 12.

In accordance with the present invention, the lamp is adapted to be operated at about a predetermined nominal wattage input, such as from 150 watts to 1000 watts, in conjunction with ballast means which generates a high-voltage starting pulse to initiate the lamp discharge and thereafter limit the current through the lamp to cause it to normally operate at about its predetermined rated wattage. To facilitate starting under the higher xenon fill pressures as specified, there is provided a trigger starting means which comprises an elongated refractory metal member 40 which connects to and extends from the supporting frame 32 to a position contiguous with and at least partially surrounding that outer surface portion of the arc tube 12 which is proximate the electrode 14 which connects to the lead-in conductor 18 and via lead-in conductor 28 to the base 24. The elongated refractory metal member is preferably formed of tantalum or niobium wire having a diameter of 0.25 mm and it also extends a predetermined distance toward the other electrode 16 along the outer surface of the arc tube and contiguous therewith.

In the operation of the lamp, when the starting pulse, which typically has a potential of 2500 to 3000 volts with a duration as measured at the base of the pulse of the 4 to 6 microseconds, is applied to the lamp, essentially the full magnitude of the pulse will be applied between the frame 32 and thus the trigger or ignitor wire 40 and the closely spaced electrode 14. This ionizes the xenon starting gas to cause an incipient discharge to occur between the electrode 14 and the inner wall portion of the arc tube 12 which is proximate the starting wire 40, because of the capacitive coupling. The ignitor starting wire 40 at least partially surrounds that outer surface portion of the arc tube 12 which is proximate the electrode 14 and as indicated, the ignitor wire also extends toward the other electrode at a predetermined distance so that the discharge, once initiated, tends to follow the path of the ignitor wire. The actual distance the wire 40 extends toward the electrode 16 is dependent upon the lamp operating parameters and lamp design. For example, the larger the diameter of the arc tube 12, the easier the lamp is to start and with a large diameter arc tube the wire 40 need only extend a relatively shorter distance, such as about half the arc length, toward the one electrode 16. However, higher xenon pressures within the foregoing range make starting more difficult and in the case of xenon pressures approaching 300 torrs, the ignitor wire 40 should extend the entire distance between the two electrodes 14 and 16. An additional design parameter is the arc length and the longer the arc length, the more difficult the discharge is to initiate, thereby making it desirable that the ignitor wire 40 extend the entire distance between the electrodes in the case of longer arc paths. As a specific example, for a short electrode spacing such as 51 mm and an arc tube I.D. of 0.8 mm, with a xenon fill pressure of 150 torrs, it is possible to start the lamp with the ignitor wire extending only about half of the distance between the two electrodes, although the ignitor wire desirably extends the entire distance of the arc for purposes of reliability. If such a lamp were to be modified to incorporate a xenon fill pressure of 290 torrs, the ignitor wire 40 should extend the entire distance between the two electrodes.

The primary discharge-sustaining constituent is sodium which is incorporated in predetermined total amount, which along with the xenon at a fill pressure between 50 torrs to 300 torrs constitutes the primary starting and operating discharge-sustaining filling. For purposes of obtaining greater normal-operation voltage drop, it is also desirable to include mercury in predetermined amount within the arc tube which will amalgamate with the sodium. In such case, a partial pressure of mercury and sodium will exist within the arc tube during normal operation thereof, with the actual pressures of these vaporized materials depending upon the lamp construction, the arc tube design, the sodium-mercury atom ratio in the amalgam, and the temperature of the unvaporized sodium-mercury amalgam at the coolest portion within the operating arc tube. As a specific example, for a lamp rated to operate at 400 watts, xenon starting gas is included therein at a fill pressure of 299 torrs and sodium plus mercury is included therein in amount of 30 mgs, with the atom ratio of sodium to mercury being 0.7. With an arc tube fabricated of single crystal sapphire having an inner diameter of 8mm and an electrode spacing of 80 mm, lamp luminous efficacies of 133 lpw have been obtained.

The higher pressures of xenon coupled with the starting arrangement provide for improved lamp efficacy as well as improved lamp spectral power distribution. As an example, a lamp rated at 400 watts and filled with 20 torrs of xenon starting gas, with no added ignitor wire, will typically operate with an efficacy of 120 lpw. When such a lamp is filled with 150 torrs with the ignitor wire added, the efficacy will typically be about 130 lpw and the spectral power distribution of the discharge will be improved. Typical operating sodium vapor pressures are in the order of 70 to 100 torrs, which will provide a high luminous efficacy. If the sodium vapor operating pressures are appreciably increased, such as from 200 to 300 torrs, the high sodium pressures coupled with the high xenon fill pressure will provide a significant emission band centered at about 561 nm which will substantially enhance the color rendering properties of the overall emission, but with some sacrifice in luminous efficacy due to increased emission in the red. The higher sodium vapor operating pressures are readily achieved by increasing the sodium to mercury atom ratio in the arc tube filling and increasing the operating temperature of the amalgam reservoir, such as by encasing the ends of the arc tube with heat reflecting shields. If sodium per se is utilized in a lamp, some modification of the ballast or arc tube redesign is desirable and for a typical lamp rated at 400 watts, the operating voltage drop across the lamp for maximum efficacy will be approximately 70 volts with the rated current being approximately 7 amps. Such a lamp can be readily started however, with the added ignitor wire. Typically, if such a lamp were to incorporate both sodium and mercury, then the nominal lamp voltage would be approximately 100 volts.

Figure 2:
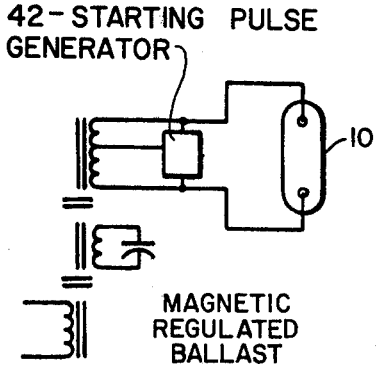
FIG. 2 is a diagrammatic view of a magnetic regulated ballast which can be used to operate the present lamp.
Figure 3:
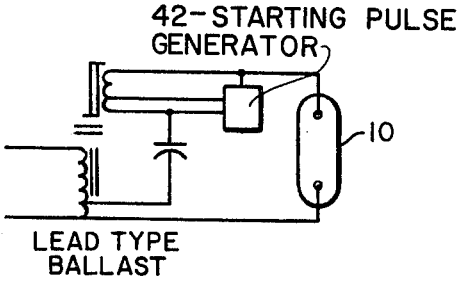
FIG. 3 is a diagrammatic view of a lead-type ballast which can be used to operate the present lamp.

In FIG. 2 is shown in diagramatic form a typical magnetic regulated ballast for operating the lamp 10 and the pulse generating mechanism 42 is shown in block diagram. In FIG. 3 is shown in diagrammatic form a conventional lead-type ballast for the lamp 10 with the pulse generator 42 being shown in block form. Such pulse generators are known in the art and once the lamp is operating, these generators are effectively cut out of the circuit. A suitable pulse generator is described in detail in copending patent application Ser. No. 540,185, filed Jan. 10, 1975 by G. F. Saletta and J. C. Engle entitled "Starting Circuits for Sodium Lamp Ballast," now U.S. Pat. No. 4,072,878, dated Feb. 7, 1978 and owned by the present assignee.

The arc tube 12 of the lamp 10 as shown in FIG. 1 is preferably fabricated of alumina either in single crystal sapphire form or as polycrystalline alumina. In the case of single crystal sapphire, the arc tube is impervious to migration of sodium ions therethrough during normal lamp operation and under the influence of an electric field. In such case, the ignitor wire 40 can remain in circuit during lamp operation. Under some conditions, polycrystalline alumina can be pervious during lamp operation to migration of sodium ions therethrough under the influence of an electric field and in such case, the ignitor wire 40 should be effectively electrically isolated from the supporting frame 32 after the lamp is operating normally. This can be readily accomplished by including in series circuit with the ignitor wire 40 a high impedance capacitor means of predetermined value, or high impedance resistor means of predetermined value, or circuit interrupting means which acts to electrically isolate the elongated ignitor wire 40 from the frame 32 after the lamp is operating normally. Thus if the arc tube, during normal lamp operation, is impervious to migration of sodium ions therethrough, the ignitor wire 40 or trigger starting means is directly electrically connected at least at one end thereof to the frame means 32. In the embodiment as shown in FIG. 1 the ignitor wire 40 is connected at both ends thereof to the frame means 32. If it is desired to electrically isolate the ignitor wire 40 from the frame means 32 during normal lamp operation, as in the alternative embodiments of FIG. 4 through 8, the ignitor wire 40 connects to the frame means 32 at one end only through a suitable electrical isolating means, as described in detail hereinafter, and as particularly shown in FIG. 8.

Figure 4:
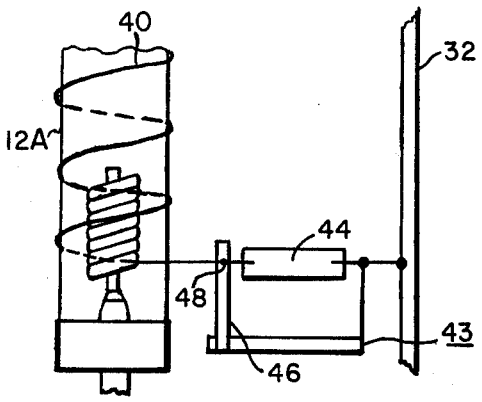
FIG. 4 is a fragmentary view of a portion of the arc tube and the supporting frame wherein a bimetal switch is used to open the circuit between the frame and the ignitor wire after the lamp is normally operating.

In FIG. 4 is shown a fragmentary portion of an arc tube and frame wherein the ignitor wire 40 is electrically isolated from the frame 32 by means of a bimetal switch 43 which is heated by the radiations from the sodium-ion-pervious arc tube 12A to cause it to open once the lamp is normally operating. In such a switch construction, an insulating member 44 parallels the bimetal 46 which upon heating opens the contact point 48 to remove the ignitor wire 40 from the circuit.

Figure 5:
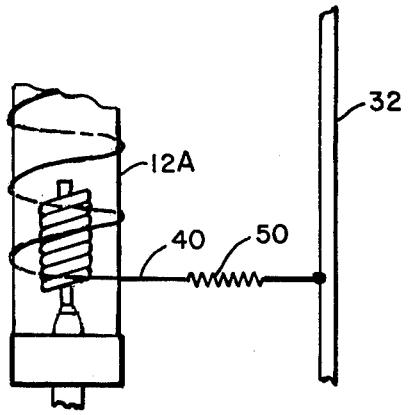
FIG. 5 is a fragmentary view of the portion of the frame and the arc tube wherein a resistor is included in series circuit between the frame and the ignitor wire.

An alternative construction is shown in FIG. 5 wherein a high impedance resistor 50 is included in circuit between the frame 32 and the ignitor wire 40 to prevent sodium ion migration through the arc tube 12A. As a specific example, the resistor is rated at 100 megohms which comprises sufficient impedance to electrically isolate the ignitor wire 40 after lamp operation is initiated.

Figure 6:
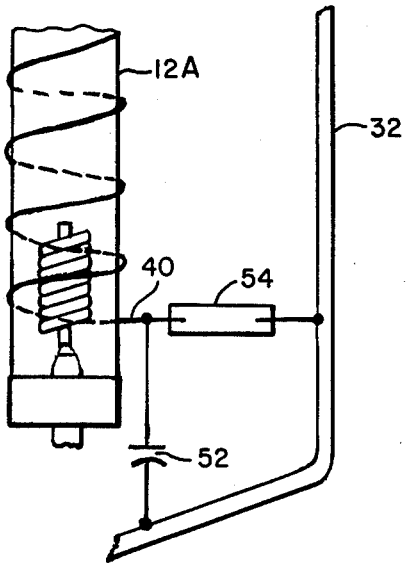
FIG. 6 is a fragmentary view of a portion of an arc tube and the supporting frame wherein a capacitor is included in series circuit between the frame and the ignitor wire.

In FIG. 6 is shown another embodiment wherein a capacitor means 52 is included in series circuit between the frame 32 and the ignitor wire 40 in order to electrically isolate same after the lamp is normally operated to prevent sodium ion migration through the arc tube 12A. As is specific example, the capacitor 52 is rated at 100 picofarads and it is supported in position by a suitable insulator glass bead member 54.

Figure 7:
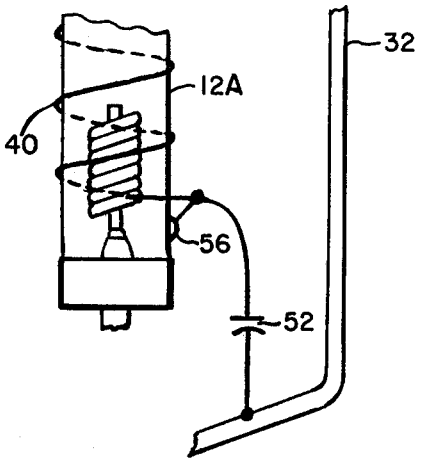
FIG. 7 is a fragmentary view of still another embodiment wherein a refractory frit is used to secure one end of the ignitor wire to the exterior surface of the arc tube.

Still another embodiment is shown in FIG. 7 wherein the capacitor 52 and the ignitor wire 40 are both secured to the outer surface of sodium-ion-pervious the arc tube 12A by means of a bead of sintered refractory frit 56. As a specific example, the frit comprises approximately 43.4 weight percent alumina, 49.5 weight percent calcia, and 7.1 weight percent silica. A small amount of this frit, such as 3 milligrams is placed on the arc tube and it is sintered by heating in vacuum at a temperature of 1350° C. To improve the adherence of the frit to the embedded ignitor wire portion, it is desirable to provide the ignitor wire with a thin coating of silicon. If it is desired to make the sintered refractory frit somewhat conductive, in order to insure electrical continuity between embedded wire portions, this can readily be achieved by including therein approximately 4 weight percent of finely divided niobium powder, such as 325 mesh material.

Figure 8:
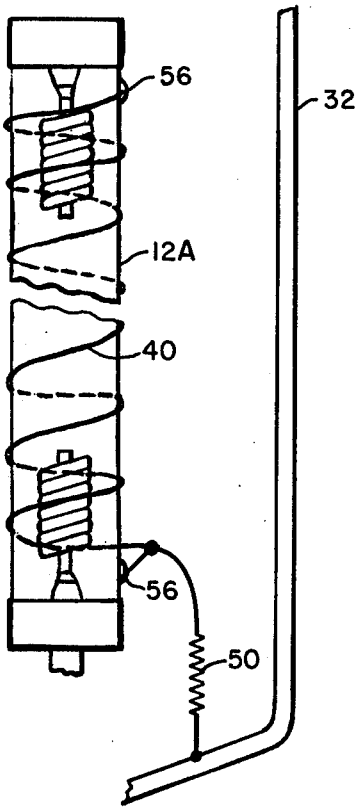
FIG. 8 is a fragmentary view of an arc tube and supporting frame wherein a refractory frit is used to secure both ends of an ignitor wire to the exterior surface of the arc tube, with the ignitor wire extending the entire length of the discharge path.

In FIG. 8 is shown in diagrammatic form yet another embodiment wherein the ignitor wire 40 extends throughout the length of the arc and both ends thereof are secured to the outer surface of the sodium-ion-pervious arc tube 12A by means of beads 56 of sintered refractory frit. More specifically, the ignitor wire 40 is connected at one end to the frame 32 through the resistor 50 and the other end of the ignitor wire 40 terminates within the uppermost bead 56. The resistor 50 thus serves to effectively electrically isolate the ignitor wire 40 from the frame 32 during normal lamp operation.

What we claim is:

1. A high-pressure sodium vapor discharge lamp adapted to be operated at about a predetermined nominal wattage input in conjunction with ballast means which generates a high-voltage starting pulse to initiate the lamp discharge and thereafter limit the current through said lamp to cause it to normally operate at about said predetermined wattage, said lamp comprising:

a. a sealed, light-transmitting, elongated, refractory arc tube of predetermined dimensions and design enclosing electrodes operatively positioned therein proximate the ends thereof, said arc tube during lamp operation is impervious to migration of sodium ions therethrough under the influence of an electrode field; a first pair of lead-in conductors sealed through said arc tube proximate the ends thereof, and one conductor of said first pair of lead-in conductors connecting to one of said electrodes and the other conductor of said first pair of lead-in conductors connecting to the other of said electrodes;

b. sodium in predetermined amount or sodium plus mercury in predetermined total amount and in predetermined atom ratio along with xenon at a fill pressure between 50 torrs to 300 torrs included in said arc tube as a starting and operating discharge-sustaining filling;

c. an outer light-transmitting envelope enclosing said arc tube to provide a predetermined operating environment therefor, external electric contact means secured to said outer envelope to provide electrical connection to said lamp, and a second pair of lead-in conductors sealed through said outer envelope and connecting to said external electrical contact means;

d. metallic supporting frame means retained within said outer envelope and supporting said arc tube therein in predetermined position and electrically connecting said one conductor of said first pair of said lead-in conductors to one conductor of said second pair of said lead-in conductors, and said other conductor of said first pair of said lead-in conductors is electrically connected to the other conductor of said second pair of said lead-in conductors;

e. trigger starting means comprising an elongated refractory metal member directly connected at least at one end thereof to said frame means, said trigger starting means extending from said supporting frame means to a position contiguous with and at least partially surrounding that outer surface portion of said arc tube which is proximate said other electrode which connects to said other conductor of said first pair of said lead-in conductors, said elongated metal member also extending a predetermined distance toward said one electrode and along the outer surface of said arc tube and contiguous therewith; and f. said predetermined discharge-sustaining filling coupled with said predetermined arc tube dimensions and design and operating environment therefor together with said nominal wattage input at which said lamp is intended to be operated causing said lamp to normally operate with about a predetermined rated voltage drop thereacross and to emit therefrom a predetermined spectral power distribution of visible emissions.

2. The lamp as specified in claim 1, wherein said arc tube is fabricated of single crystal sapphire.

3. A high-pressure sodium vapor discharge lamp adapted to be operated at about a predetermined nominal wattage input in conjunction with ballast means which generates a high-voltage starting pulse to initiate the lamp discharge and thereafter limit the current through said lamp to cause it to normally operate at about said predetermined wattage, said lamp comprising:

a. a sealed, light-transmitting, elongated, refractory arc tube of predetermined dimensions and design enclosing electrodes operatively positioned therein proximate the ends thereof; a first pair of lead-in conductors sealed through said arc tube proximate the ends thereof, and one conductor of said first pair of lead-in conductors connecting to one of said electrodes and the other conductor of said first pair of lead-in conductors connecting to the other of said electrodes;

b. sodium in predetermined amount or sodium plus mercury in predetermined total amount and in predetermined atom ratio along with xenon at a fill pressure between 50 torrs to 300 torrs included in said arc tube as a starting and operating discharge-sustaining filling;

c. an outer light-transmitting envelope enclosing said arc tube to provide a predetermined operating environment therefor, external electric contact means secured to said outer envelope to provide electrical connection to said lamp, and a second pair of lead-in conductors sealed through said outer envelope and connecting to said external electrical contact means;

d. metallic supporting frame means retained within said outer envelope and supporting said arc tube therein in predetermined position and electrically connecting said one conductor of said first pair of said lead-in conductors to one conductor of said second pair of said lead-in conductors, and said other conductor of said first pair of said lead-in conductors is electrically connected to the other conductor of said second pair of said lead-in conductors;

e. trigger starting means comprising an elongated refractory metal member connecting to and extending from said supporting frame means to a position contiguous with and at least partially surrounding that outer surface portion of said arc tube which is proximate said other electrode which connects to said other conductor of said first pair of said lead-in conductors, said elongated metal member also extending a predetermined distance toward said one electrode and along the outer surface of said arc tube and contiguous therewith; said arc tube during lamp operation is pervious to migration of sodium ions therethrough under the influence of an electric field, said elongated metal member is effectively electrically isolated from said supporting frame means after said lamp is normally operating by having in series circuit therewith high impedance capacitor means of predetermined value to electrically isolate said elongated metal member from said frame means after said lamp is normally operating; and f. said predetermined discharge-sustaining filling coupled with said predetermined arc tube dimensions and design and operating environment therefor together with said nominal wattage input at which said lamp is intended to be operated causing said lamp to normally operate with about a predetermined rated voltage drop thereacross and to emit therefrom a predetermined spectral power distribution of visible emissions.

4. The lamp as specified in claim 3, wherein said elongated metal member is connected to said frame means via a rigid insulating member, and said capacitor means is connected intermediate said frame and said elongated metal member to be in series circuit with said elongated metal member and mechanically supported by said rigid insulating member.

5. A high-pressure sodium vapor discharge lamp adapted to be operated at about a predetermined nominal wattage input in conjunction with ballast means which generates a high-voltage starting pulse to initiate the lamp discharge and thereafter limit the current through said lamp to cause it to normally operate at about said predetermined wattage, said lamp comprising:

a. a sealed, light-transmitting, elongated, refractory arc tube of predetermined dimensions and design enclosing electrodes operatively positioned therein proximate the ends thereof; a first pair of lead-in conductors sealed through said arc tube proximate the ends thereof, and one conductor of said first pair of lead-in conductors connecting to one of said electrodes and the other conductor of said first pair of lead-in conductors connecting to the other of said electrodes;

b. sodium in predetermined amount or sodium plus mercury in predetermined total amount and in predetermined atom ratio along with xenon at a fill pressure between 50 torrs to 300 torrs included in said arc tube as a starting and operating discharge-sustaining filling;

c. an outer light-transmitting envelope enclosing said arc tube to provide a predetermined operating environment therefor, external electric contact means secured to said outer envelope to provide electrical connection to said lamp, and a second pair of lead-in conductors sealed through said outer envelope and connecting to said external electrical contact means;

d. metallic supporting frame means retained within said outer envelope and supporting said arc tube therein in predetermined position and electrically connecting said one conductor of said first pair of said lead-in conductors to one conductor of said second pair of said lead-in conductors, and said other conductor of said first pair of said lead-in conductors is electrically connected to the other conductor of said second pair of said lead-in conductors;

e. trigger starting means comprising an elongated refractory metal member connecting to and extending from said supporting frame means to a position contiguous with and at least partially surrounding that outer surface portion of said arc tube which is proximate said other electrode which connects to said other conductor of said first pair of said lead-in conductors, said elongated metal member also extending a predetermined distance toward said one electrode and along the outer surface of said arc tube and contiguous therewith, said elongated metal member is affixed to the outer surface of said arc tube at least at one location thereon by a refractory frit which is sintered to the surface of said arc tube; and in the case said arc tube during lamp operation is pervious to migration of sodium ions therethrough under the influence of an electric field, said elongated metal member is effectively electrically isolated from said supporting frame means after said lamp is normally operating by having in series circuit therewith high impedance capacitor means of predetermined value, or high impedance resistor means of predetermined value, or circuit interrupting means acting to electrically isolate said elongated metal member from said frame means after said lamp is normally operating; and f. said predetermined discharge-sustaining filling coupled with said predetermined arc tube dimensions and design and operating environment therefor together with said nominal wattage input at which said lamp is intended to be operated causing said lamp to normally operate with about a predetermined rated voltage drop thereacross and to emit therefrom a predetermined spectral power distribution of visible emissions.

6. The lamp as specified in claim 5, wherein said elongated metal member is affixed by sintered refractory frit to the outer surface of said arc tube at a first location proximate said other electrode, and said elongated metal member is also affixed to the outer surface of said arc tube by sintered refractory frit at a second location proximate the extremity of the extension of said elongated metal member toward said one electrode.

7. A high-pressure sodium vapor discharge lamp adapted to be operated at about a predetermined nominal wattage input in conjunction with ballast means which generates a high-voltage starting pulse to initiate the lamp discharge and thereafter limit the current through said lamp to cause it to normally operate at about said predetermined wattage, said lamp comprising:

a. a sealed, light-transmitting, elongated, refractory arc tube of predetermined dimensions and design enclosing electrodes operatively positioned therein proximate the ends thereof; a first pair of lead-in conductors sealed through said arc tube proximate the ends thereof, and one conductor of said first pair of lead-in conductors connecting to one of said electrodes and the other conductor of said first pair of lead-in conductors connecting to the other of said electrodes;

b. sodium in predetermined amount or sodium plus mercury in predetermined total amount and in predetermined atom ratio along with xenon at a fill pressure between 50 torrs to 300 torrs included in said arc tube as a starting and operating discharge-sustaining filling;

c. an outer light-transmitting envelope enclosing said arc tube to provide a predetermined operating environment therefor, external electric contact means secured to said outer envelope to provide electrical connection to said lamp, and a second pair of lead-in conductors sealed through said outer envelope and connecting to said external electrical contact means;

d. metallic supporting frame means retained within said outer envelope and supporting said arc tube therein in predetermined position and electrically connecting said one conductor of said first pair of said lead-in conductors to one conductor of said second pair of said lead-in conductors, and said other conductor of said first pair of said lead-in conductors is electrically connected to the other conductor of said second pair of said lead-in conductors;

e. trigger starting means comprising an elongated refractory metal member connecting to and extending from said supporting frame means to a position contiguous with and at least partially surrounding that outer surface portion of said arc tube which is proximate said other electrode which connects to said other conductor of said first pair of said lead-in conductors, said elongated metal member extending along the outer surface of said arc tube from a location proximate said other electrode to a location proximate said one electrode, said elongated metal member is affixed to said arc tube by refractory frit sintered thereto at a first location proximate said other electrode and also at a second location proximate said one electrode; and in the case said arc tube during lamp operation is pervious to migration of sodium ions therethrough under the influence of an electric field, said elongated metal member is effectively electrically isolated from said supporting frame means after said lamp is normally operating by having in series circuit therewith high impedance capacitor means of predetermined value, or high impedance resistor means of predetermined value, or circuit interrupting means acting to electrically isolate said elongated matal member from said frame means after said lamp is normally operating; and f. said predetermined discharge-sustaining filling coupled with said predetermined arc tube dimensions and design and operating environment therefor together with said nominal wattage input at which said lamp is intended to be operated causing said lamp to normally operate with about a predetermined rated voltage drop thereacross and to emit therefrom a predetermined spectral power distribution of visible emissions.

* * * * *